US007976018B2

(12) United States Patent
Ueda

(10) Patent No.: US 7,976,018 B2
(45) Date of Patent: Jul. 12, 2011

(54) DISCHARGED-SHEET MONITORING MECHANISM AND METHOD FOR PRINTER

(75) Inventor: Takaomi Ueda, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 12/585,345

(22) Filed: Sep. 11, 2009

(65) Prior Publication Data

US 2010/0066005 A1 Mar. 18, 2010

(30) Foreign Application Priority Data

Sep. 12, 2008 (JP) ..... P2008-235343
Sep. 12, 2008 (JP) ..... P2008-235361
Jul. 31, 2009 (JP) ..... P2009-179772

(51) Int. Cl.
*B65H 31/10* (2006.01)

(52) U.S. Cl. ..... 271/207; 271/176

(58) Field of Classification Search ..... 271/207, 271/176, 110, 276; 270/52.06, 58.02, 58.09; 399/405, 407
See application file for complete search history.

(56) References Cited

U.S. PATENT DOCUMENTS 5,033,731 A * 7/1991 Looney ..... 271/176
5,350,169 A * 9/1994 Hiroi et al. ..... 271/213
5,961,115 A * 10/1999 Blanck et al. ..... 271/263
6,113,094 A * 9/2000 Horiguchi et al. ..... 271/176
6,574,013 B1 * 6/2003 Koshi ..... 358/441
7,717,421 B2 * 5/2010 Rennick et al. ..... 271/207
2004/0245703 A1 * 12/2004 Yun et al. ..... 271/110

FOREIGN PATENT DOCUMENTS

JP 05-301430 11/1993
JP 2005-239323 9/2005

* cited by examiner

*Primary Examiner* — Kaitlin S Joerger
(74) *Attorney, Agent, or Firm* — The Nath Law Group; Jerald L. Meyer; Jiaxiao Zhang

(57) ABSTRACT

A discharged sheet monitoring mechanism for a printer includes: a paper receiving tray configured to receive and stack discharged printed sheets thereon; a stack amount detector configured to detect a stack amount of discharged sheets stacked on the paper receiving tray; a remaining amount calculator configured to calculate a remaining amount based on the stack amount detected by the stack amount detector, the remaining amount being a difference in amount between the stack amount and a maximum stacking amount of the paper receiving tray; a sheet type acquisition unit configured to acquire a type of a sheet to be printed; a dischargeable sheet amount calculator configured to calculate a dischargeable number of sheets further stackable on the paper receiving tray until the paper receiving tray is full therewith based on the remaining amount calculated by the remaining amount calculator and the sheet type acquired by the sheet type acquisition unit; and a notification unit configured to notify the dischargeable number of sheets calculated by the dischargeable sheet amount calculator.

18 Claims, 11 Drawing Sheets

DISCHARGED-SHEET MONITORING MECHANISM AND METHOD FOR PRINTER

CROSS REFERENCE TO RELATED APPLICATIONS

This application is based upon and claims the benefit of priority from the prior Japanese Patent Application Nos. 2008-235343 and 2008-235361 filed on Sep. 12, 2008 and the prior Japanese Patent Application No. 2009-179772 filed on Jul. 31, 2009, the entire contents of which are incorporated herein by reference.

BACKGROUND OF THE INVENTION

1. Field of the Invention

The present invention relates to a discharged-sheet monitoring mechanism and method for a printer such as an inkjet printer.

2. Description of the Related Art

In recent years, image forming apparatuses which perform large-volume printing and copying have been heavily used. Such image forming apparatuses include printers, facsimiles, copiers and the like. In general, an image forming apparatus is equipped as standard with a sheet discharge device configured to stack sheets having images formed thereon on a paper receiving tray. Such a sheet discharge device is desired to have a sheet stacking unit having a huge capacity. However, the stacking capacity of the sheet discharge device has limitations. When large-volume printing causes sheets to be discharged beyond the stacking capacity of the sheet discharge device, a discharged sheet jam, such as a paper jam or a fall of a sheet from the stack, occurs.

To prevent an overflow (full state) which is a cause of such a discharged sheet jam, there are techniques disclosed in Japanese Patent Application Publications Nos. 2005-239323 and Hei 5-301430. The technique disclosed in Japanese Patent Application Publication No. 2005-239323 includes: determining whether or not the amount of sheets stacked on a paper receiving tray has reached a maximum amount allowed; and then stopping units upstream of the paper receiving tray if necessary. Here, the determination is made by use of a method in which a detection sensor detects a sheet stack height on the paper receiving tray or a method in which a further printable amount is detected by counting the number of printed sheets. In the technique disclosed in Japanese Patent Application Publication No. Hei 5-301430, a remaining discharged-sheet stacking amount of a sheet discharge device is detected, and a notification such as a warning or an error display is provided to a user to prompt the user to take away printed sheets discharged to the sheet discharge device.

However, in the further printable amount detection method disclosed in the above-described Japanese Patent Application Publication No. 2005-239323, consideration is not given to the different thicknesses of various types of print sheets. Accordingly, this technique does not enable a determination on an accurate amount of sheets further printable until the amount of sheets discharged to the paper receiving tray reaches the maximum amount allowed. In the case of Japanese Patent Application Publication No. Hei 5-301430 in which a notification is provided to a user, only a notification is provided when the amount of sheets discharged to the paper receiving tray reaches a certain level, but the amount of sheets further dischargeable cannot be displayed. Accordingly, users cannot make the best use of a maximum amount allowed of the paper receiving tray, and spend a lot of time on printing work and sheet-discharging work.

Further, there is a case where large-volume printing so-called JOB data is executed as a single process. In this case, when an overflow occurs on the paper receiving tray during job processing, the entire job processing is stopped in the techniques disclosed in the above-described patent documents. Accordingly, despite a single batch of job data, print sheets discharged to the paper receiving tray are separated into two or more groups due to the stoppage of job processing. This may considerably reduce the efficiency of user's work.

SUMMARY OF THE INVENTION

The present invention has been made in view of the above-described points and an object of the present invention is to provide a printer discharged-sheet monitoring mechanism and method which is capable of improving the efficiency of user's work and enabling a user to make the best use of the maximum discharged-sheet stacking amount of a paper receiving tray, by recognizing the type of a discharged sheet, the remaining amount of the paper receiving tray and the like; calculating an accurate further dischargeable number of sheets; and notifying the user of this calculated accurate dischargeable number of sheets.

Moreover, the present invention has been made in view of the above-described points and another object of the present invention is to provide a printer discharged-sheet monitoring mechanism and method which is capable of preventing a single batch of user's print job data from being suspended during printing and enabling a user to make the best use of the maximum discharged-sheet stacking amount of a paper receiving tray by recognizing the type of a discharged sheet, the remaining amount of the paper receiving tray, and the like, calculating an accurate further dischargeable number of sheets, and notifying the user of this accurate further dischargeable number of sheets.

To achieve the above object, a first aspect of the present invention is a discharged sheet monitoring mechanism for a printer, comprising: a paper receiving tray configured to receive and stack discharged printed sheets thereon; a stack amount detector configured to detect a stack amount of discharged sheets stacked on the paper receiving tray; a remaining amount calculator configured to calculate a remaining amount based on the stack amount detected by the stack amount detector, the remaining amount being a difference in amount between the stack amount and a maximum stacking amount of the paper receiving tray; a sheet type acquisition unit configured to acquire a type of a sheet to be printed; a dischargeable sheet amount calculator configured to calculate a dischargeable number of sheets further stackable on the paper receiving tray until the paper receiving tray is full therewith based on the remaining amount calculated by the remaining amount calculator and the sheet type acquired by the sheet type acquisition unit; and a notification unit configured to provide notification of the dischargeable number of sheets calculated by the dischargeable sheet amount calculator.

According to the first aspect, the dischargeable number of sheets is calculated based on the remaining amount calculated from the sheet stack amount of the paper receiving tray and the sheet type acquired by the sheet type acquisition unit. Accordingly, the user can be notified of an accurate dischargeable number of sheets calculated with consideration given to the thickness of a sheet to be used by the user. Thus, the user can give a print instruction after comparing the dischargeable number of sheets indicated by the notification unit and the number of sheets that a user desires to print. This can reduce the occurrence of a discharged sheet jam and improve the working efficiency of printing.

The discharged sheet monitoring mechanism may further comprise: a print data processor configured to process multiple-sheet printing as a single batch of job data; and a comparator configured to compare a number of sheets to be printed contained in the job data and the dischargeable number of sheets, and the notification unit may provide notification of a result of the comparison performed by the comparator.

In the above-described configuration, the dischargeable number of sheets is calculated based on the remaining amount calculated from the sheet stack amount of the paper receiving tray and the sheet type acquired by the sheet type acquisition unit. Accordingly, a user can be notified of an accurate dischargeable number of sheets calculated with consideration given to the thickness of a sheet to be used by the user. In this case, the dischargeable number of sheets is compared with the number of sheets to be printed put into a single batch as job data by the user. The user is then notified of the result of the comparison. Accordingly, in the case where discharged sheets stacked on the paper receiving tray overflows if a print operation is executed, the user can perform work such as taking discharged sheets away from the paper receiving tray before a print job as a single batch is executed. This prevents the printing of print sheets of the print job as a single batch from being suspended, and improves the efficiency of user's work.

The discharged sheet monitoring mechanism may further comprise: a storage configured to store the sheet type acquired by the sheet type acquisition unit as history information; and an estimator configured to analyze types of sheets used for printing based on the history information stored in the storage, and the dischargeable sheet amount calculator may correct the dischargeable number of sheets based on a sheet type estimated by the estimator.

In the above-described configuration, the estimator considers the types of sheets printed in the past by a user as history information, and uses this history information to correct the dischargeable number of sheets calculated as the remaining amount. Accordingly, an appropriate current maximum dischargeable number of sheets can be calculated with consideration given to not only the current sheet settings but also the tendency of past sheet uses.

The sheet type acquisition unit may acquire the type of a sheet to be printed by acquiring information on a sheet type specified through an operation by a user.

In the above-described configuration, the sheet type can be acquired based on operations performed by a user through an operation panel or a print application (driver). Accordingly, it is possible to calculate a dischargeable number of sheets which reflects the intent of a user.

The sheet type acquisition unit may acquire the type of a sheet to be printed by acquiring information on a paper feed pressure set in a paper feed unit configured to feed a sheet to a conveyance route for conveying the sheet for image formation.

In the above-described configuration, since the sheet type is determined based on the paper feed pressure of the paper feed unit, a more accurate dischargeable number of sheets can be calculated.

The stack amount detector may comprise a light receiving sensor configured to detect a presence of a discharged sheet and detect the stack amount of discharged sheets stacked on the paper receiving tray based on a length of time during which the light receiving sensor continuously detects a discharged sheet. It should be noted that the light receiving sensor configured to detect the presence of a sheet may be a reflection type which detects a sheet by sensing light reflected from the sheet or a transmission type which detects a sheet by sensing light being shaded by the sheet.

In the above-described configuration, a stack amount can be measured by sensing light reflected from sheets or light shaded by the sheets at a predetermined height where the light receiving sensor is located, and then determining whether or not there are stacked sheets at the predetermined height. Also, even when the stack amount does not reach the predetermined height, the falling speed of a sheet can be measured by measuring the time during which the light receiving sensor continuously detects the sheet due to the passage of the discharged sheet in the course of discharging the sheet from the sheet conveyance route to the paper receiving tray. That is, since the falling speed of a sheet varies depending on air resistance and the like during the fall, the time during which the light receiving sensor continuously senses the presence of a sheet varies depending on the falling distance according to the height of sheets stacked on the paper receiving tray. Accordingly, even when the stack amount does not reach the height at which the light receiving sensor is located, the current stack amount of the paper receiving tray can be estimated by detecting the length of the above-described sensing time. Thus, it is possible to calculate the remaining amount which is the height of discharged sheets further stackable until the paper receiving tray is full.

The paper receiving tray may be provided at an end of a discharging route for discharging a printed sheet, the discharging route being branched from and connected to a conveyance route for conveying a sheet for image formation, the stack amount detector may comprise a light receiving sensor configured to detect a presence of a discharged sheet by emitting irradiation light and by receiving reflected light of the emitted irradiation light from the sheet discharged from the discharging route, the light receiving sensor being located at a height corresponding to a predetermined percentage of the maximum stacking amount of the paper receiving tray, and the stack amount detector may detect the stack amount of discharged sheets stacked on the paper receiving tray based on a length of time during which the light receiving sensor continuously detects the presence of a discharged sheet.

In the above-described configuration, a stack amount can be measured by sensing light reflected from sheets or light shaded by the sheets at a predetermined height where the light receiving sensor is located, and then determining whether or not there are stacked sheets at the predetermined height. Also, even when the stack amount does not reach the predetermined height, the falling speed of a sheet can be measured by measuring the time during which the light receiving sensor continuously detects the sheet due to the passage of the discharged sheet in the course of discharging the sheet from the sheet conveyance route to the paper receiving tray. That is, since the falling speed of a sheet varies depending on air resistance and the like during the fall, the time during which the light receiving sensor continuously senses the presence of a sheet varies depending on the falling distance according to the height of sheets stacked on the paper receiving tray. Accordingly, even when the stack amount does not reach the height at which the light receiving sensor is located, the current stack amount of the paper receiving tray can be estimated by detecting the length of the above-described sensing time. Thus, it is possible to calculate the remaining amount which is the height of discharged sheets further stackable until the paper receiving tray is full.

To achieve the above object, a second aspect of the present invention is a method for monitoring a discharged sheet, the method comprising: detecting a stack amount of discharged sheets stacked on a paper receiving tray configured to receive discharged printed sheets; calculating a remaining amount based on the stack amount detected in the stack amount detecting step, the remaining amount being a difference in amount between the stack amount and a maximum stacking amount of the paper receiving tray; acquiring a type of a sheet to be printed; calculating a dischargeable number of sheets further stackable on the paper receiving tray until the paper receiving tray is full therewith based on the remaining amount calculated in the remaining amount calculating step and the sheet type acquired in the sheet type acquiring step; and providing notification of the dischargeable number of sheets calculated in the dischargeable number of sheets calculating step.

According to the second aspect, the dischargeable number of sheets is calculated based on the remaining amount calculated from the sheet stack amount detected in the stack amount detecting step and the sheet type acquired in the sheet type acquiring step. Accordingly, the user can be notified of an accurate dischargeable number of sheets calculated with consideration given to the thickness of a sheet to be used by the user. Thus, the user can give a print instruction after comparing the dischargeable number of sheets reported in the notifying step and the number of sheets that a user desires to print. This can reduce the occurrence of a discharged sheet jam and improve the working efficiency of printing.

The method for monitoring a discharged sheet may further comprise: processing multiple-sheet printing as a single batch of job data; and comparing a number of sheets to be printed contained in the job data and the dischargeable number of sheets. And in the notifying step, a result of the comparison performed in the comparing step may be reported.

In the above-described configuration, the dischargeable number of sheets is calculated based on the remaining amount calculated from the sheet stack amount detected in the stack amount detecting step and the sheet type acquired in the sheet type acquiring step. Accordingly, a user can be notified of an accurate dischargeable number of sheets calculated with consideration given to the thickness of a sheet to be used by the user. In this case, the dischargeable number of sheets is compared with the number of sheets to be printed put into a single batch as job data by the user. Accordingly, in the case where discharged sheets stacked on the paper receiving tray overflows if a print operation is executed, that effect can be reported to the user.

The method for monitoring a discharged sheet may further comprise: storing the sheet type acquired in the sheet type acquiring step as history information; and analyzing types of sheets used for printing based on the history information stored in the storing step. And in the dischargeable sheet amount calculating step, the dischargeable number of sheets may be corrected based on a sheet type estimated in the estimating step.

In the above-described configuration, the types of sheets printed in the past by a user are considered as history information, and this history information is used to correct the dischargeable number of sheets calculated as the remaining amount in the dischargeable number of sheets calculating step. Accordingly, an appropriate current maximum dischargeable number of sheets can be calculated with consideration given to not only current sheet settings but also the tendency of past sheet uses.

In the sheet type acquiring step, the type of a sheet to be printed may be acquired by acquiring information on a sheet type specified through an operation by a user.

In the above-described configuration, the sheet type can be acquired based on operations performed by a user through an operation panel or a print application (driver). Accordingly, it is possible to calculate a dischargeable number of sheets which reflects the intent of a user.

In the sheet type acquiring step, the type of a sheet to be printed may be acquired by acquiring information on a paper feed pressure set in a paper feed unit configured to feed a sheet to a conveyance route for conveying the sheet for image formation.

In the above-described configuration, since the sheet type is determined based on the paper feed pressure of the paper feed unit, a more accurate dischargeable number of sheets can be calculated.

In the stack amount detecting step, the stack amount of discharged sheets stacked on the paper receiving tray may be detected by a light receiving sensor configured to detect a presence of a discharged sheet and provided to the paper receiving tray, based on a length of time during which the light receiving sensor continuously detects a discharged sheet.

In the above-described configuration, a stack amount can be measured by determining whether or not there are stacked sheets at a predetermined height where the light receiving sensor is located. Also, even when the stack amount does not reach the predetermined height, the current stack amount of the paper receiving tray can be estimated. Thus, it is possible to calculate the remaining amount which is the height of discharged sheets further stackable until the paper receiving tray is full.

In the stack amount detecting step, the stack amount of discharged sheets stacked on the paper receiving tray may be detected based on a length of time during which a light receiving sensor continuously detects a presence of a discharged sheet, the paper receiving tray being provided at an end of a discharging route for discharging a printed sheet, the discharging route branched from and connected to a conveyance route for conveying a sheet for image formation, the light receiving sensor being located at a height corresponding to a predetermined percentage of a maximum stacking amount of the paper receiving tray and configured to detect the presence of a discharged sheet by emitting irradiation light and by receiving reflected light of the emitted irradiation light from the sheet discharged from the discharging route.

In the above-described configuration, a stack amount can be measured by sensing light reflected from sheets or light shaded by the sheets at a predetermined height where the light receiving sensor is located, and then determining whether or not there are stacked sheets at the predetermined height. Also, even when the stack amount does not reach the predetermined height, the falling speed of a sheet can be measured by measuring the time during which the light receiving sensor continuously detects the sheet due to the passage of the discharged sheet in the course of discharging the sheet from the sheet conveyance route to the paper receiving tray. That is, since the falling speed of a sheet varies depending on air resistance and the like during the fall, the time during which the light receiving sensor continuously senses the presence of a sheet varies depending on the falling distance according to the height of sheets stacked on the paper receiving tray. Accordingly, even when the stack amount does not reach the height at which the light receiving sensor is located, the current stack amount of the paper receiving tray can be estimated by detecting the length of the above-described sensing time. Thus, it is possible to calculate the remaining amount which is the height of discharged sheets further stackable until the paper receiving tray is full.

The above-described configurations can improve the efficiency of user's work and enable a user to make the best use of the maximum stacking Amount of the paper receiving tray in a printer such as an inkjet printer by recognizing the type of a discharged sheet, the remaining amount of the paper receiving tray, and the like, calculating an accurate further dischargeable number of sheets, and notifying the user of this dischargeable number of sheets.

Moreover, in a printer such as an inkjet printer, an accurate further dischargeable number of sheets is calculated by recognizing the type of a discharged sheet, the remaining amount of the paper receiving tray, and the like, and this dischargeable number of sheets is reported to the user. At that time, the dischargeable number of sheets is compared with the number of sheets to be printed put into a single batch as job data by the user. The result of the comparison is reported to the user. This prevents the printing of print sheets of a single batch of user's print job data from being suspended, and makes the best use of the maximum stacking amount of the paper receiving tray.

DETAILED DESCRIPTION OF THE EMBODIMENT

Overall Configuration of Printer

Figure 1:
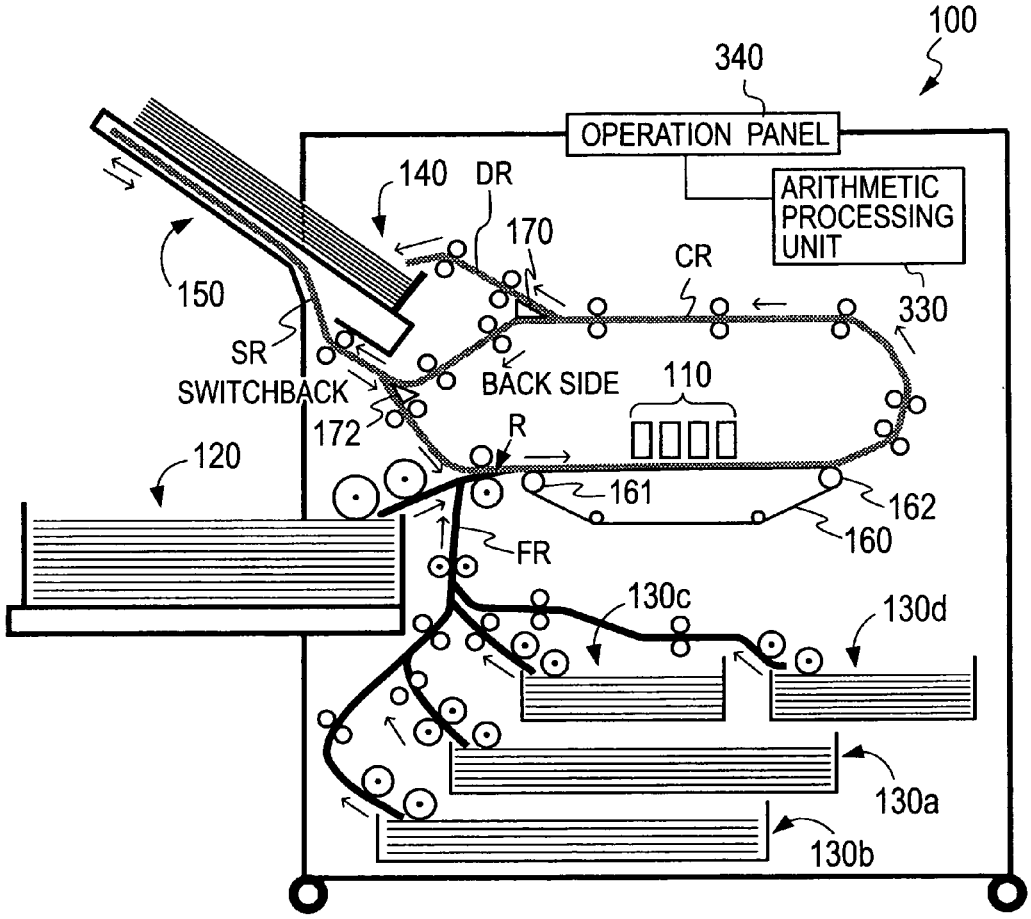
FIG. 1 is a view schematically showing print sheet conveyance routes of a printer according to an embodiment of the present invention.

An embodiment of the present invention will be described with reference to the drawings. FIG. 1 is a view schematically showing print sheet conveyance routes of a printer 100 according to this embodiment. In this embodiment, the case where the printer 100 is a color inkjet line printer will be described as an example. In general, a Color inkjet line printer includes multiple ink heads each having multiple nozzles formed therein, performs printing line-by-line by ejecting black or color ink from each ink head, and forms several images on a recording sheet on a conveyer belt in superimposing manner.

As shown in FIG. 1, the printer 100 is a machine configured to form an image on the surface of a sheet being conveyed on a conveyance route having a looped shape. The conveyance routes principally include a feeding route FR configured to feed a sheet, a common route CR extending from the feeding route FR, then passing a head unit 110, and finally reaching a discharging route DR, and a switchback route SR branched from and connected to the common route CR.

The feeding route FR includes the following paper feed units, each configured to feed a print sheet: a side paper feed tray 120 provided outward of a side surface of a cabinet of the printer 100, and several paper feed trays (130*a*, 130*b*, 130*c*, and 130*d*) provided in the cabinet. As a sheet discharge unit configured to discharge a printed sheet, a discharge port 140 is provided.

A print sheet fed from any one of the paper feed units, i.e., any one of the side paper feed tray 120 and the paper feed trays 130*a* to 130*d*, is conveyed along the feeding route FR in the cabinet by a driving mechanism including rollers or the like to be guided to a registration part R, which is a reference position for the leading edge of a print sheet. The head unit 110 including several print heads is provided on the downstream side of the registration part R in a conveying direction. The print sheet is subjected to line-by-line image formation by ink ejected from the print heads while being conveyed by a conveyer belt 160 at a speed determined by print conditions. The conveyer belt 160 is provided in a plane which the head unit 110 faces.

The printed sheet is further conveyed on the common route CR by a driving mechanism including the rollers or the like. In the case of one-sided printing in which only one side of the print sheet is subjected to printing, the print sheet is guided directly to the discharge port 140 through the discharging route DR to be discharged. Thereafter, the printed sheet is stacked on a paper receiving tray 150 provided as a receiving table at the discharge port 140 with the printed side thereof facing down. The paper receiving tray 150 is in the form of a tray protruding from the cabinet and has a certain thickness. The paper receiving tray 150 is inclined so that print sheets discharged from the discharge port 140 is automatically stacked neatly by a wall formed on the lower side of the paper receiving tray 150.

On the other hand, in the case of double-side printing in which both sides of a print sheet are subjected to printing, the print sheet is not guided to the discharging route DR at the time of the completion of front-side printing (a side which is first subjected to printing is referred to as a "front side," and a side which is next subjected to printing is referred to as a "back side"), but is further conveyed in the cabinet to be sent out to the switchback route SR. Accordingly, the printer 100 is provided with a switching unit 170 configured to switch the conveyance route for back-side printing. A print sheet caused not to be sent out to the discharging route DR by the switching unit 170 is drawn into the switchback route SR.

The switchback route SR receives the print sheet from the common route CR, and performs so-called switchback in which the print sheet is inverted by moving the print sheet forward and then backward. The print sheet is returned to the common route CR via a switching unit 172 by a driving mechanism including the rollers or the like, refed through the registration part R, and subjected to back-side printing through procedures similar to those for front-side printing. Thereafter, the print sheet having images formed on both sides thereof is guided to the discharge port 140 through the discharging route DR to be discharged, and stacked on the paper receiving tray 150 provided as a receiving table at the discharge port 140.

In this embodiment, the switchback for double-side printing is performed by utilizing a space provided in the paper receiving tray 150. The space provided in the paper receiving tray 150 has a covered structure so that a print sheet cannot be taken out from the outside during switchback. This prevents a user from drawing out a print sheet in inversion motion by mistake. The paper receiving tray 150 is originally provided to the printer 100. Performing switchback by utilizing a space in the paper receiving tray 150 eliminates the necessity of providing an additional space for switchback in the printer 100. This prevents an increase in the size of the cabinet. Further, since discharging and switchback routes are provided separately from each other, a switchback process for a sheet and a discharging process for another sheet can be performed in parallel.

In the printer 100, in the case of double-side printing, a print sheet having one side already printed is also refed to the registration part R, which is the reference position for the leading edge of a fed print sheet. Accordingly, immediately before the registration part R, a confluence is formed at which a conveyance route for a newly fed print sheet meets a refeeding route. On the refeeding route, a print sheet for back-side printing is circulated. The registration part R sends out a sheet in the vicinity of the confluence, where the feeding route FR meets the common route CR.

Figure 2:
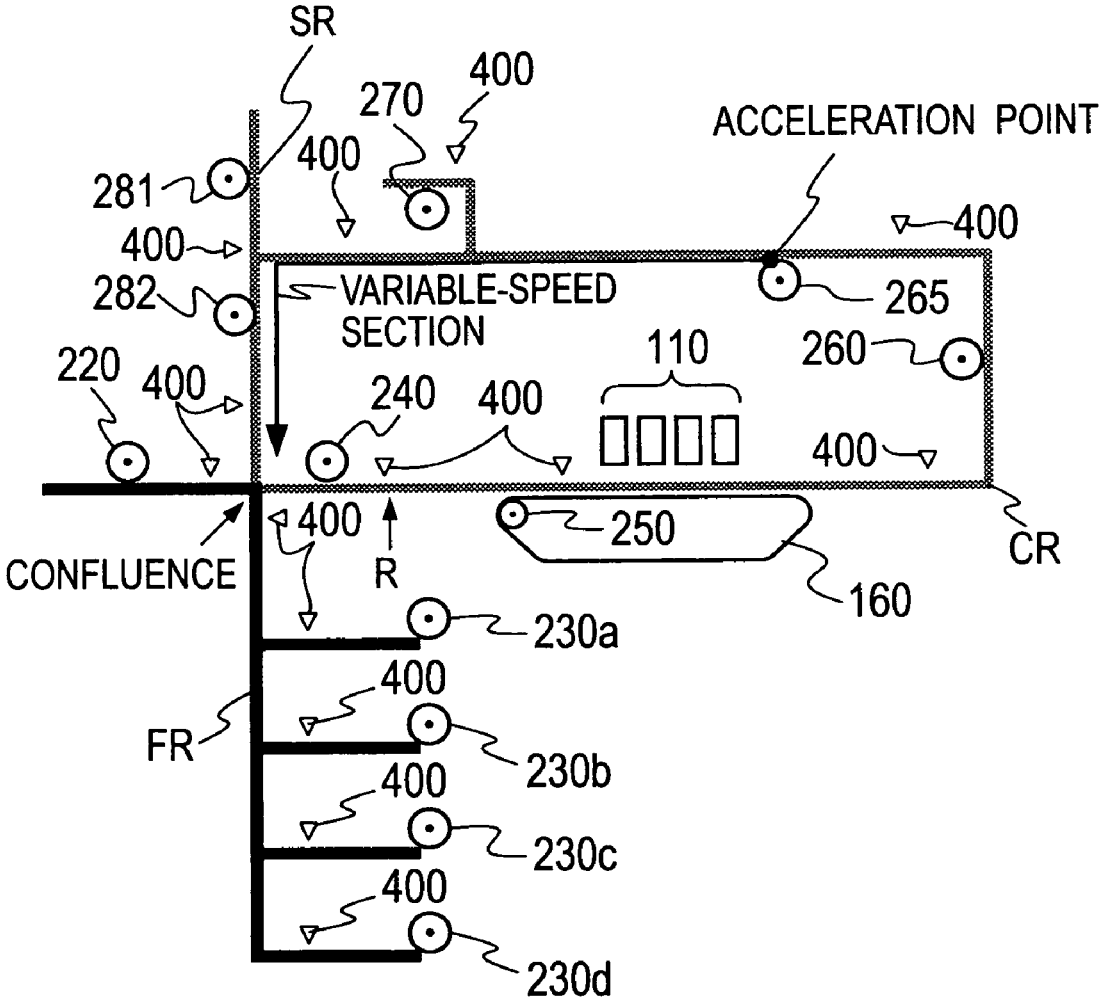
FIG. 2 is a view schematically showing a feeding route, a common route, and a switchback route according to the embodiment of the present invention.

In this embodiment, the feeding route FR is defined as a route on a paper feed unit side with respect to the above-described confluence, and other routes are collectively referred to as a looped conveyance route. This looped conveyance route includes the common route CR and the switchback route SR as described above. FIG. 2 is a view schematically showing the feeding route FR, the common route CR, and the switchback route SR. In FIG. 2, some of the rollers of driving units are omitted from the drawing for the sake of simplicity.

The feeding route FR is provided with a side paper feed drive unit 220 configured to feed a sheet from the side paper feed tray 120, and further provided with tray-1, tray-2, tray-3, and tray-4 drive units 230*a*, 230*b*, 230*c*, and 230*d* configured to feed sheets from the paper feed trays 130*a*, 130*b*, 130*c*, and 130*d*. These constitute paper feed means which sends out a sheet to the registration part R.

Each of the above-described drive units (side paper feed drive unit 220 and tray-1, tray-2, tray-3, and tray-4 drive units 230*a*, 230*b*, 230*c*, and 230*d*) of the feeding route FR has a driving mechanism including several rollers or the like, and takes in print sheets stacked on the paper feed tray one by one to convey the print sheets in the direction of the registration part R. Each drive unit can be independently actuated. When a paper feed unit feeds a sheet, the drive unit corresponding to the paper feed unit is actuated.

The feeding route FR is provided with several conveyance sensors 400 so that a paper jam in the feeding route FR can be detected. That is, each conveyance sensor 400 is a sensor configured to detect the presence or absence of a print sheet or detect the leading edge of a print sheet. For example, the several conveyance sensors 400 are arranged on the conveyance route at appropriate intervals. Then, in the case where the conveyance sensor 400 provided on a paper feed side has detected a print sheet but the conveyance sensor 400 on a downstream side in the conveyance direction has not detected the print sheet within a predetermined period of time after the detection, a determination can be made that a paper jam has occurred.

Of these conveyance sensors 400, a registration sensor located upstream of the registration part R which sends out a sheet measures the size of a sheet being conveyed, e.g., measures the size of a sheet passing-by based on the passage speed and time of the sheet. In the case where the conveyance sensors 400 have not detected a print sheet within a predetermined period of time after the side paper feed drive unit 220, the tray-1 drive unit 230*a*, or the like has been actuated, a determination is made that a paper jam (paper feed error) has occurred.

The common route CR constitutes part of the looped conveyance route, and is a route extending from the feeding route FR, which feeds a sheet, then passing the head unit 110, and finally reaching the discharging route DR. On this common route CR, an image is formed on the upper surface of a sheet. The common route CR is provided with a registration drive unit 240 configured to guide a print sheet to the registration part R, a belt drive unit 250 which is actuated to endlessly move the conveyer belt 160 provided in the plane which the head unit 110 faces, first and second upper surface conveyance drive units 260 and 265 located in the conveyance direction in this order, a second upper surface conveyance drive unit 282, an upper surface discharging drive unit 270 configured to guide a printed sheet to the discharge port 140, and drive means configured to draw a print sheet into the switchback route SR for back-side printing. Each of these drive units has a driving mechanism including one or more rollers or the like, and conveys print sheets along the conveyance route one by one. Each of these drive units can be independently actuated. In accordance with the situation of conveyance of a print sheet, required drive units are actuated.

The common route CR is also provided with conveyance sensors 400 so that a paper jam in the common route CR can be detected. Also at the registration part R, a check can be made as to whether or not a print sheet is being appropriately conveyed. For the common route CR, the conveyance sensors 400 are provided to correspond to the drive units, thus allowing the identification of which drive unit on the common route CR a paper jam has occurred at.

The switchback route SR is an inverting route and a conveying mechanism which is branched from and connected to the common route CR, and is configured to receive a sheet from the common route CR, and inverts the print sheet by moving the print sheet forward and then backward (switchback) and returning the print sheet to the common route CR. The switchback route SR is provided with a switchback drive unit 281 configured to invert and guide a sheet to the confluence. On the switchback route SR, conveyance can be performed at a speed different from that of the common route CR. This enables acceleration or deceleration of a sheet when the sheet is transferred from the common route CR, and also enables the expansion or reduction of pause time during switchback.

In this embodiment, printing can be continuously performed at predetermined intervals by scheduling in such a manner that before a preceding print sheet is discharged, a subsequent print sheet is fed, but not in such a manner that after a print sheet is fed, then subjected to printing, and finally discharged, a subsequent print sheet is fed. Accordingly, in usual scheduling for double-side printing, a space is beforehand ensured when a sheet for front-side printing is fed so that a position at which a sheet returned from the switchback route SR is inserted is ensured. This enables this machine to perform front-side printing and back-side printing in parallel and ensure productivity higher than ½ of that for one-sided printing.

The conveyer belt 160 is passed over a drive roller 161 and a driven roller 162 disposed at front and back ends in the plane which the head unit 110 faces, and rotates in the clockwise direction in FIG. 1. Along the upper surface of the conveyer belt 160, the head unit 110 is placed to face the conveyer belt 160. The head unit 110 includes four ink heads of yellow (Y), magenta (M), cyan (C), and black (K) arranged in the travel direction of the belt, and forms a color image by superimposing several images.

As shown in FIG. 1, the printer 100 has an arithmetic processing unit 330. The arithmetic processing unit 330 is an arithmetic module made of hardware including: a processor such as a CPU or digital signal processor (DSP), memory, and other electronic circuits; software including programs having such functions; or a combination of hardware and software. The arithmetic processing unit 330 virtually constructs various function modules by appropriately reading and executing programs, and uses the constructed function modules to perform processing relating to image data, the control of operation of other units, and various kinds of processing on operations by a user. To the arithmetic processing unit 330, an operation panel 340 is connected so that instructions and setting operations can be received from the user through the operation panel 340.

(Discharged Sheet Monitoring Mechanism)

Figure 3:
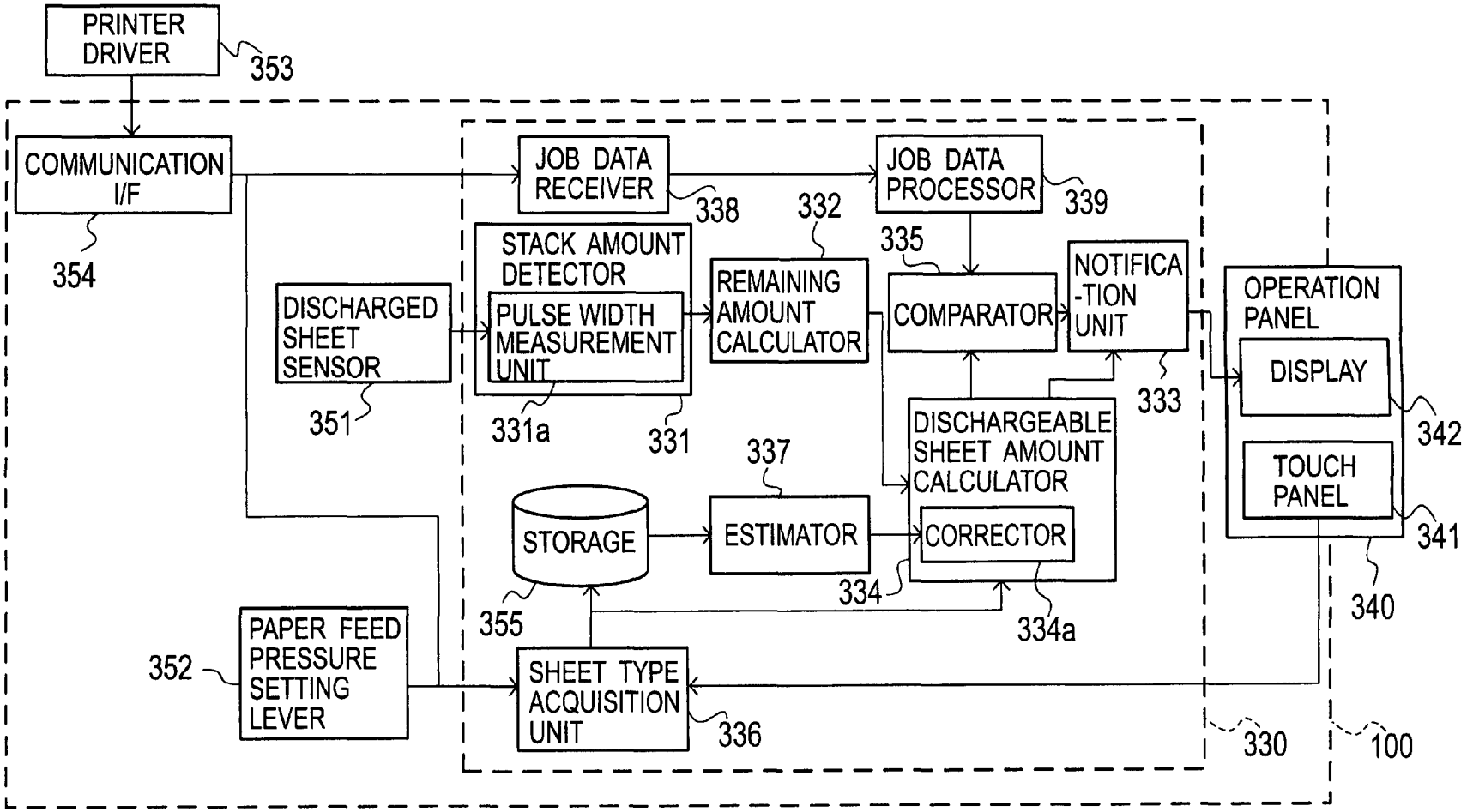
FIG. 3 is a block diagram showing function modules of an arithmetic processing unit according to the embodiment of the present invention, the function modules relating to discharged sheet monitoring.

A discharged sheet monitoring mechanism of this embodiment is implemented by the arithmetic processing unit 330 causing a discharged sheet sensor to perform detection. FIG. 3 is a block diagram showing function modules of the arithmetic processing unit 330 which relate to discharged sheet monitoring. The word "module" used in this description refers to a functional unit made of hardware such as devices and instruments, software having such functions, or a combination of hardware and software to achieve predetermined operations.

As shown in FIG. 3, the modules relating to the discharged sheet monitoring mechanism are broadly divided into four groups: a sheet type recognition module group, a paper receiving tray remaining amount calculation module group, a dischargeable sheet amount notification module group, and a JOB data acquisition module group. Each module group will be described below.

The sheet type recognition module group includes a sheet type acquisition unit 336, storage 355, and an estimator 337. The paper receiving tray remaining amount calculation module group includes a stack amount detector 331 and a remaining amount calculator 332.

The sheet type acquisition unit 336 is a module configured to acquire the type of a sheet on which the head unit 110 is to form an image. The sheet type acquisition unit 336 acquires the type of a sheet currently relating to print processing by reading out processings performed by a user through a printer driver 353 and the operation panel 340 and a setting on a paper feed pressure setting lever 352 located in the printer 100. The sheet type acquisition unit 336 then sends the acquired sheet type data to the storage 355 and a dischargeable sheet amount calculator 334. The storage 355 is a module configured to store and maintain the sheet type data acquired by the sheet type acquisition unit 336 as history information, and sends out the sheet type data to the estimator 337. The sheet type data may contain information such as the thickness, size (area), weight, shape, and the like of the sheet. In particular, the respective weights of different sheet types may be capable of being set or changed depending on the area or environment where the printer is used. This is because humidity, which affects the weights of sheets, may greatly vary depending on the area or environment where the printer is used.

Figure 8A:
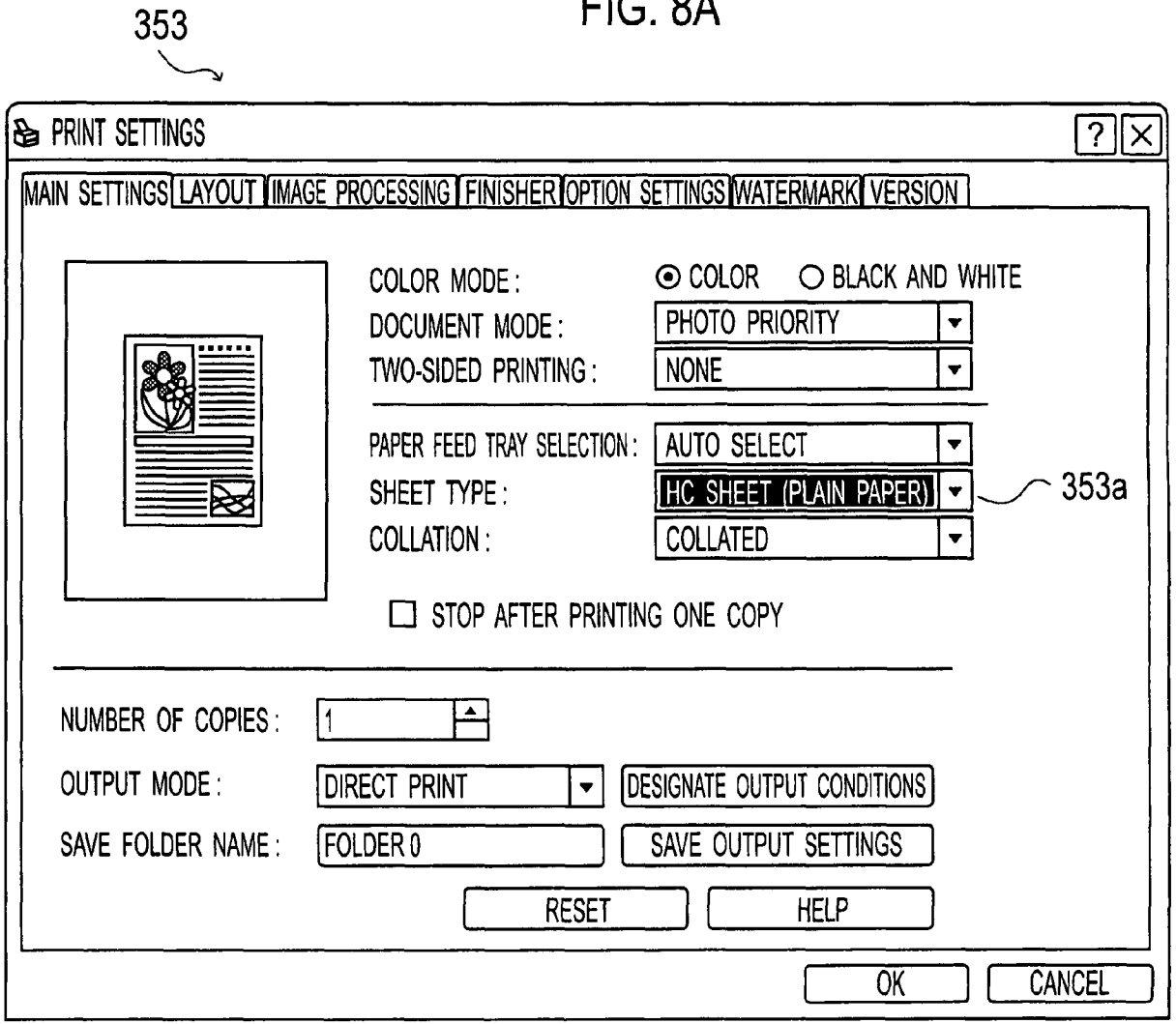
FIGS. 8A and 8B are configuration diagrams each showing an operation screen of a printer driver according to the embodiment of the present invention.
Figure 8B:
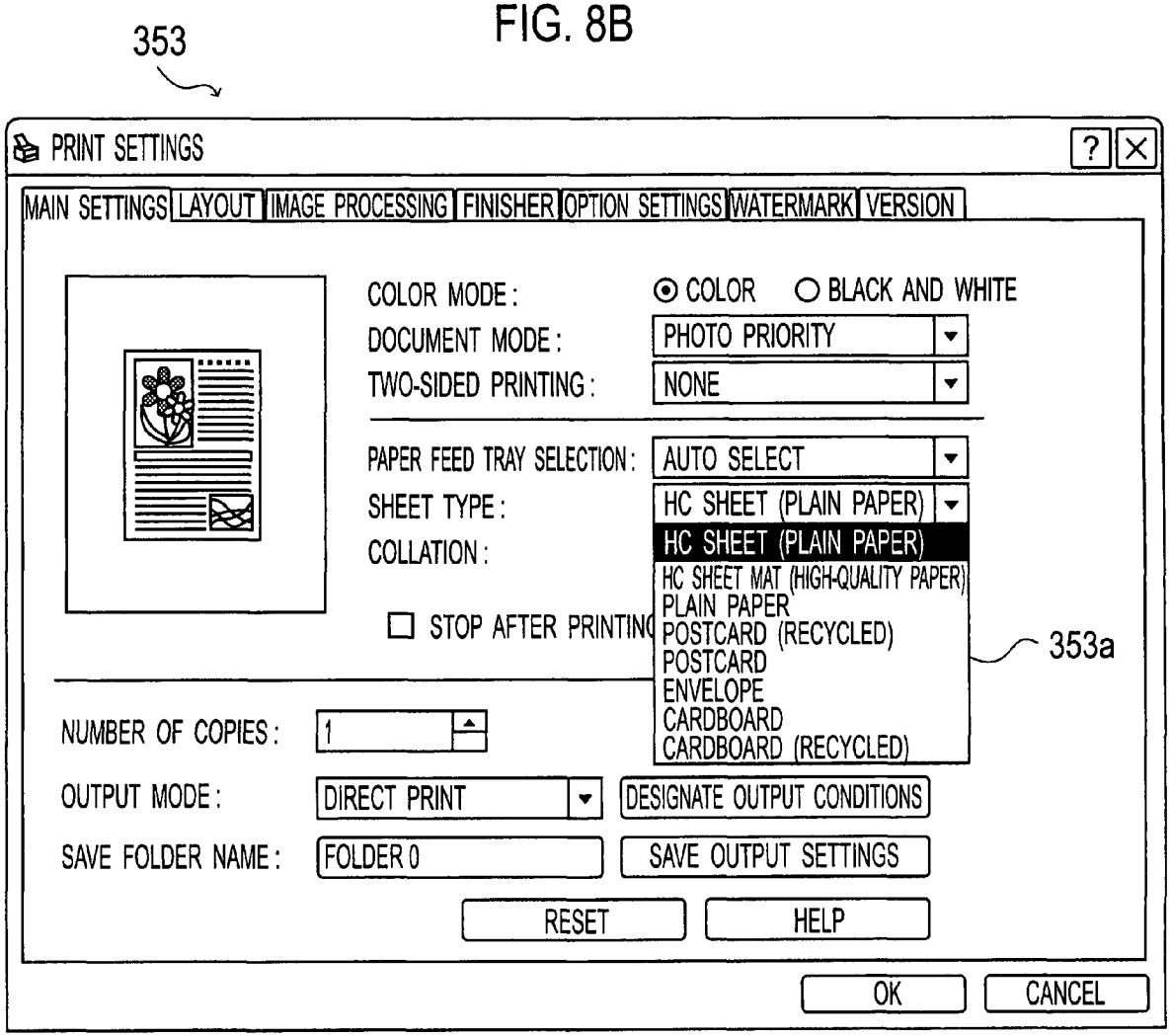

The printer driver 353 is an application or middleware, such as shown in FIGS. 8A and 8B, which is executed on each client PC in the case where, for example, this printer is used as a network printer. The printer driver 353 can send print data and executive instructions to the printer 100 through a communication I/F 354. In this embodiment, the printer driver 353 includes a combo box 353*a* configured to set a sheet type, so that a user can select a sheet type by pulling down this combo box 353*a* and selecting an item. A sheet thickness is acquired in accordance with this sheet type selection.

The estimator 337 is a module configured to estimate a sheet type for the current printing based on history information of each sheet type for a user stored on the storage 355. Specifically, the estimator 337 accumulates sheet types for sheets printed in the past, calculates an average of the sheet thicknesses, and estimates the next sheet thickness at the average. The estimator 337 sends out the estimated data to the dischargeable sheet amount calculator 334.

In this embodiment, the current sheet type and the sheet type estimated based on the history information are sent out to the dischargeable sheet amount calculator 334 by a combination of the sheet type acquisition unit 336, the storage 355, and the estimator 337.

Figure 6:
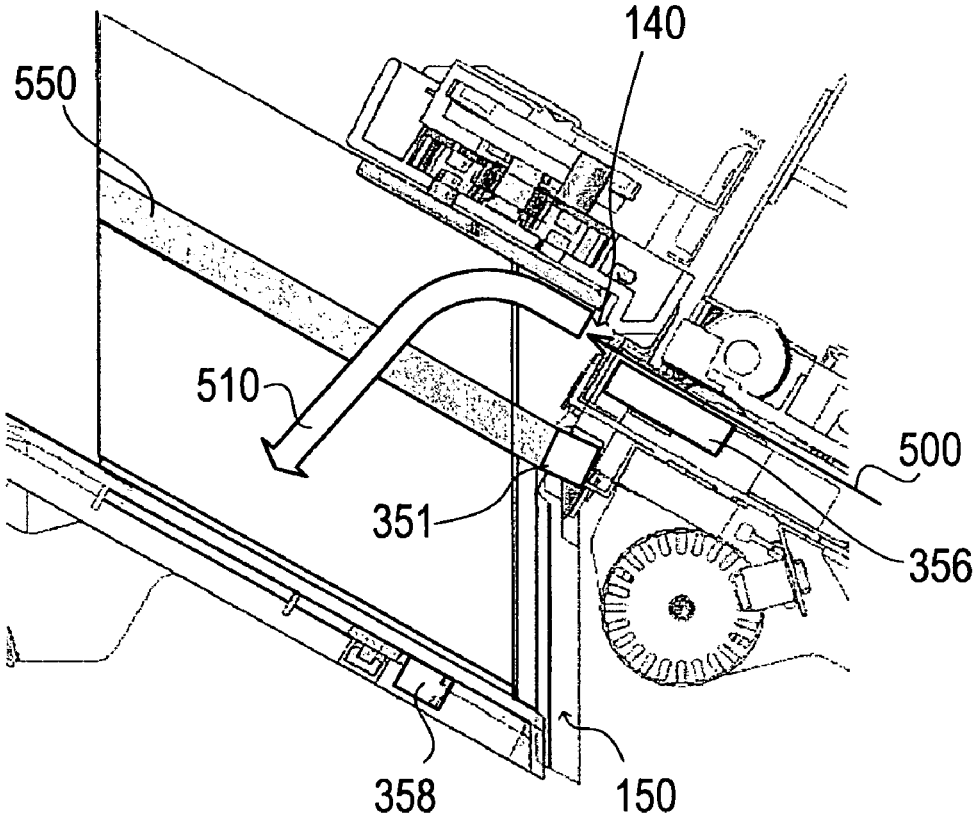
FIG. 6 is a cross-sectional view showing the configuration of a paper receiving tray according to the embodiment of the present invention.

The stack amount detector 331 is a module configured to detect the stack amount (height) of sheets stored on the paper receiving tray 150. The stack amount detector 331 has a pulse width measurement unit 331*a* configured to measure the length of time during which a discharged sheet sensor 351 provided in the paper receiving tray 150 continuously receives light reflected from a discharged sheet. Further, as shown in FIG. 6, an FD discharged sheet sensor (FD discharged sheet motor encoder) 356 is provided in the vicinity of the discharge port 140 on the discharging route DR, thus being located upstream of the discharged sheet sensor 351. Moreover, a discharged sheet detection sensor 358 is provided at the lowest surface of the paper receiving tray 150. On this lowest surface, discharged sheets are stacked. The discharged sheet detection sensor 358 is a sensor configured to receive light reflected from discharged sheets and thereby detect whether or not discharged sheets are stacked on the paper receiving tray 150. The FD discharged sheet sensor 356 is a light receiving sensor configured to receive light reflected from a sheet and thereby detect the presence of the sheet. Although the FD discharged sheet sensor 356 and the discharged sheet detection sensor 358 are provided in this embodiment, these sensors do not necessarily need to be provided.

The discharged sheet sensor 351 is provided in the paper receiving tray 150 as shown in FIG. 6, and is a light receiving sensor configured to emit irradiation light (for the purpose of explanation, the range irradiated with the emitted light is shown in FIG. 6), receive the light reflected from sheets (discharged sheets), and thereby detect the presence of the sheets. In FIG. 6, an arrow 500 indicates the motion of a sheet being conveyed on the conveyance route in the vicinity of the discharge port 140, an arrow 510 indicates the motion of a discharged sheet, and a reference numeral 550 indicates the range irradiated with the light emitted by the discharged sheet sensor 351. The discharged sheet sensor 351 is located at a height corresponding to 80% of a maximum discharged-sheet stacking amount of the paper receiving tray 150, so that the fact that the stack amount has reached 80% can be detected when sheets are stacked to the height of the discharged sheet sensor 351. The stack amount detector 331 also detects a stack amount less than 80% with the pulse width measurement unit 331*a*. Although in this embodiment, the discharged sheet sensor 351 is located at the height corresponding to 80% of the maximum discharged-sheet stacking amount of the paper receiving tray 150, the present invention is not limited to this. The height at which the discharged sheet sensor 351 is located can be determined as desired.

The detection by the FD discharged sheet sensor 356 and that by the discharged sheet sensor 351 at the paper receiving tray 150 are shown in FIGS. 5 and 7A to 7C. In each of FIGS. 5 and 7A to 7C, a detection pulse (sheet discharging timing) of the FD discharged sheet sensor 356 is shown in an upper portion, and a detection pulse of the discharged sheet sensor 351, which is a light receiving sensor, is shown in a lower portion. For the detection pulse of the FD discharged sheet sensor 356 shown in each upper portion, the vertical axis is signal intensity (output signal voltage), and the horizontal axis is time. For the detection pulse of the discharged sheet sensor 351 shown in each lower portion, the vertical axis is signal intensity (output signal voltage), and the horizontal axis is time. The sheet discharging timing shown in each upper portion and the horizontal axis (time axis) of the detection pulses of the discharged sheet sensor 351 shown in each lower portion correspond to each other in terms of time.

Figure 5:
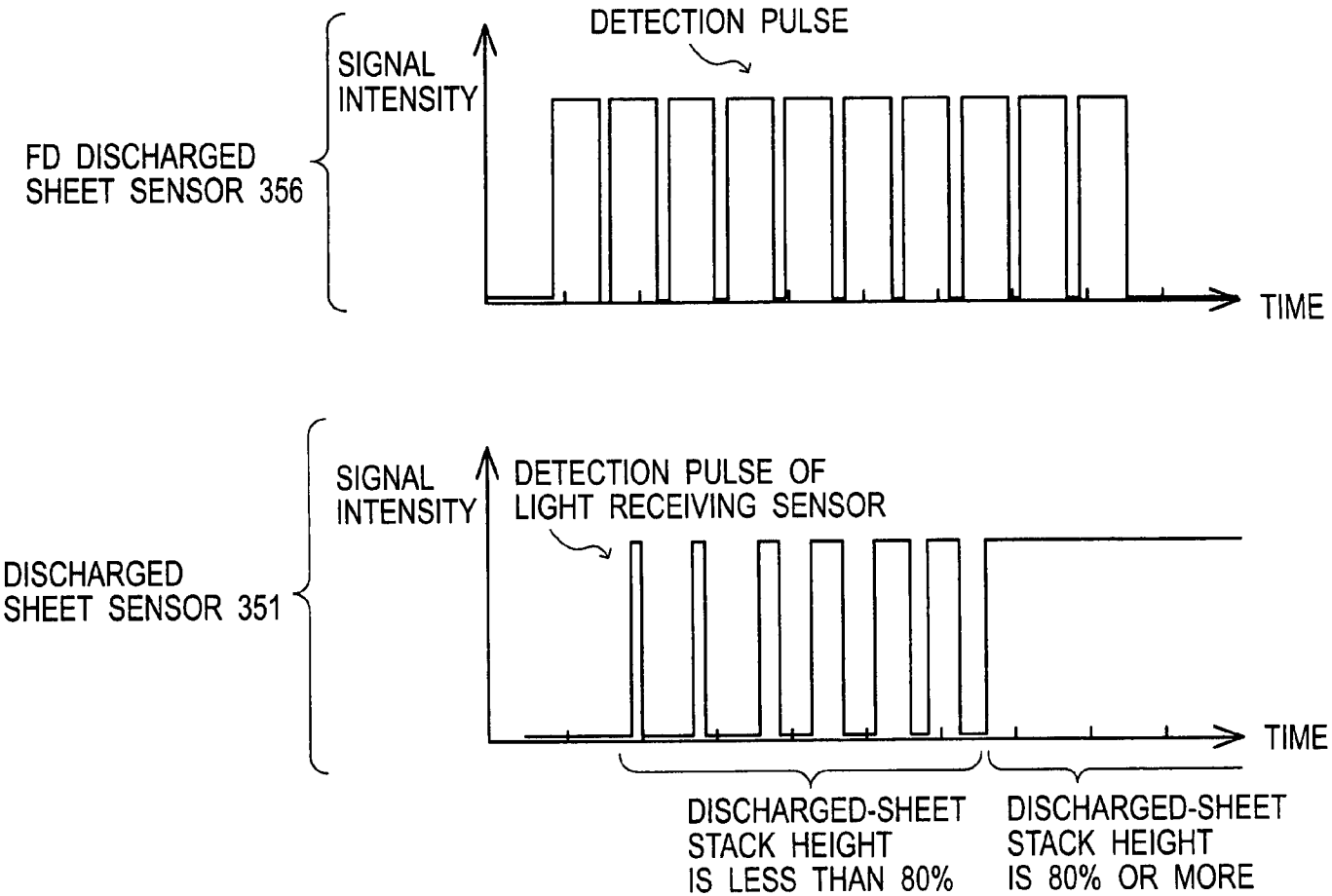
FIG. 5 is a graph showing pulse signal and sheet discharge timing of discharged sheet sensors (light receiving sensors) according to the embodiment of the present invention.

That is, the vertical axis of each lower portion indicates whether or not the discharged sheet sensor 351 has received light (reflected light) reflected from a discharged sheet when a print sheet has passed in front of the discharged sheet sensor 351. The horizontal axis of each lower portion indicates the width of a pulse of the discharged sheet sensor 351. The pulse width indicates the length of time during which the discharged sheet sensor 351 continuously receives light reflected from the discharged sheet. In this way, the discharged sheet sensor 351 outputs, as a pulse signal, the length of time during which the discharged sheet sensor 351 continuously receives light reflected from a discharged sheet. Based on the pulse width, the volume (height) of discharged sheets stacked on the paper receiving tray 150 can be estimated or detected. As shown in FIG. 5, when the stack amount of discharged sheets becomes or exceeds 80% of the maximum stacking amount of the paper receiving tray, the discharged sheet sensor 351 continuously receives light. Accordingly, whether or not the stack amount of discharged sheets has reached 80% of the maximum stacking amount can be detected by checking the on/off of the signal from the discharged sheet sensor 351.

Even in the case where the stack amount of discharged sheets is less than 80% of the maximum stacking amount of the paper receiving tray, the stack amount of discharged sheets can be estimated by measuring the length (pulse width) of time during which the discharged sheet sensor 351 continuously receives reflected light due to the passage of a discharged sheet in the course of discharging the sheet to the paper receiving tray 150. That is, at the paper receiving tray 150, the falling speed of a discharged sheet varies depending on air resistance and the like during the fall. This air resistance and the like vary depending on the height of discharged sheets stacked on the paper receiving tray 150. Accordingly, as shown in FIGS. 5 and 7A to 7C, for each of discharged sheets having the same size, weight, shape, and the like, the light receiving time varies depending on the falling distance of the discharged sheet. The falling distance varies depending on the height of discharged sheets stacked on the paper receiving tray 150. It should be noted that in FIG. 5, the reason why the last light receiving time in the range in which the stack amount of discharged sheets is less than 80% is shorter than the immediately preceding light receiving time is that the sizes, weights, and the like of discharged sheets are different between the two pulses. Accordingly, the estimation of the stack amount of discharged sheets is performed with consideration also given to sheet-type-dependent factors including the sizes, weights, and shapes of discharged sheets.

Figure 7A:
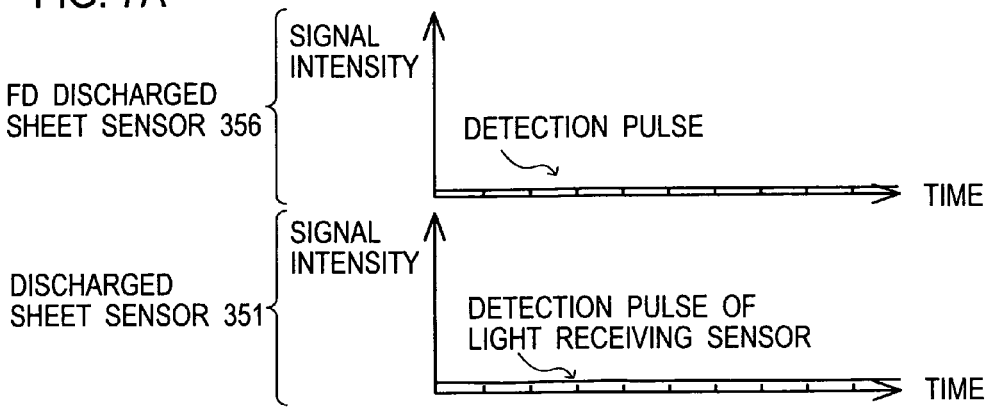
FIGS. 7A to 7C are graphs each showing pulse signal and sheet discharge timing of the discharged sheet sensors (light receiving sensors) according to the embodiment of the present invention.
Figure 7B:
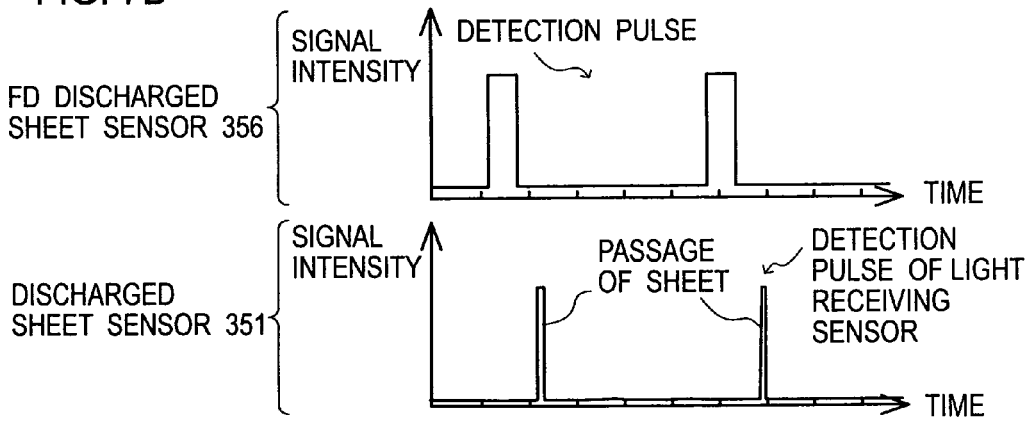
Figure 7C:
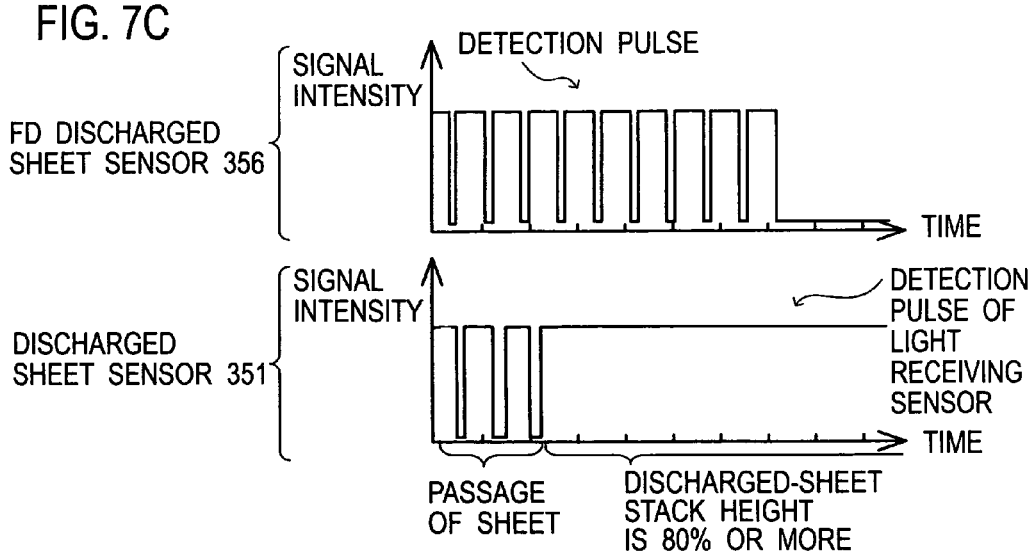

Specifically, in the state shown in FIG. 7A (the state where no sheet is stacked on the paper receiving tray 150), the discharged sheet sensor 351 is not detecting a sheet. This means that no sheet is being discharged. In the state shown in FIG. 7B, the discharged sheet sensor 351 detects discharged sheets twice but does not detect reflected light at the right end of the horizontal axis. This means that the stack amount of discharged sheets does not reach 80% of the maximum stacking amount of the paper receiving tray 150. In the state shown in FIG. 7C, each of the portions in which pulses are high indicates that a discharged sheet is passing by the discharged sheet sensor 351. The portion in which a pulse continuously remains high indicates that the discharged sheet sensor 351 remains detecting reflected light. This indicates that the stack amount of discharged sheets has reached 80% of the maximum stacking amount of the paper receiving tray 150.

As described above, detecting this light receiving time in the pulse width measurement unit 331*a* makes it possible to measure the passage time of a discharged sheet in the detection range of the discharged sheet sensor 351, estimate the current stack amount of the paper receiving tray 150, and calculate a remaining amount, which is the height of sheets further stackable until the paper receiving tray 150 is full.

The remaining amount calculator 332 is a module configured to calculate, based on the stack amount detected by the stack amount detector 331, the remaining amount which is the height of sheets further stackable until the paper receiving tray 150 is full. Specifically, in the case where the signal from the discharged sheet sensor 351 continuously remains on, the remaining amount calculator 332 determines the stack amount to be not less than 80%. On the other hand, in the case where the signal is a pulse, the remaining amount calculator 332 calculates the stack amount based on the pulse width.

In this embodiment, the remaining amount of the paper receiving tray 150 is calculated and sent out to the dischargeable sheet amount calculator 334 by a combination of the stack amount detector 331 and the remaining amount calculator 332.

The dischargeable sheet amount notification module group includes a dischargeable sheet amount calculator 334, a notification unit 333, and a comparator 335. The JOB data acquisition module group includes a job data receiver 338 and a job data processor 339.

The dischargeable sheet amount calculator 334 is a module configured to calculate a dischargeable number of sheets based on the sheet type data acquired from the sheet type acquisition unit 336 or the estimator 337 and data on the remaining amount of the paper receiving tray 150 acquired from the remaining amount calculator 332. Specifically, the dischargeable sheet amount calculator 334 considers the remaining amount as the height of discharged sheets further stackable, and divides this height by the sheet thickness according to the sheet type, thus calculating the remaining number of sheets further stackable as a dischargeable number of sheets. The dischargeable sheet amount calculator 334 sends out the calculated dischargeable number of sheets to the comparator 335 and the notification unit 333.

The dischargeable sheet amount calculator 334 has a corrector 334*a*. The corrector 334*a* is a module configured to correct the dischargeable number of sheets. Specifically, in the case where a selection is made as to whether the sheet type information acquired directly from the sheet type acquisition unit 336 or the sheet type information estimated by the estimator 337 is used to calculate the dischargeable number of sheets, the corrector 334*a* replaces the sheet type inputted directly from the sheet type acquisition unit 336 with the selected sheet type, and corrects the dischargeable number of sheets based on thickness data for the sheet type after replacement. This sheet type information selection is made in the case where the two sheet thicknesses are compared and the difference therebetween is not less than a reference value. Specifically, the sheet type information selection is made based on a selecting operation which a user is requested to perform by displaying a message to the user. The sheet type information selection may be set to automatic selection in which either sheet type information is preferentially selected in the case where the difference between the two sheet thicknesses is not less than the reference value.

The job data receiver 338 is a module configured to receive, through the communication interface (I/F) 354, print JOB data sent from other devices. For example, such communication interfaces include a data transmission/reception circuit configured to connect to a communication network such as the Internet or a LAN. The job data receiver 338 sends out JOB data received through the communication interface 354 to the job data processor 339.

The job data processor 339 is a module configured to process multiple-sheet printing as a single batch of job data. The job data processor 339 analyzes the JOB data inputted from the job data receiver 338, extracts the number of sheets to be printed contained in the job data, and the number of sheets to be printed is inputted to the comparator 335.

The comparator 335 is a module configured to compare the number of sheets to be printed contained in the job data inputted from the job data processor 339 and the dischargeable number of sheets calculated by the dischargeable sheet amount calculator 334. Based on the comparison, the comparator 335 determines whether or not the number of sheets to be printed contained in the job data exceeds the dischargeable number of sheets, and the result of this determination is inputted to the notification unit 333.

Figure 9:
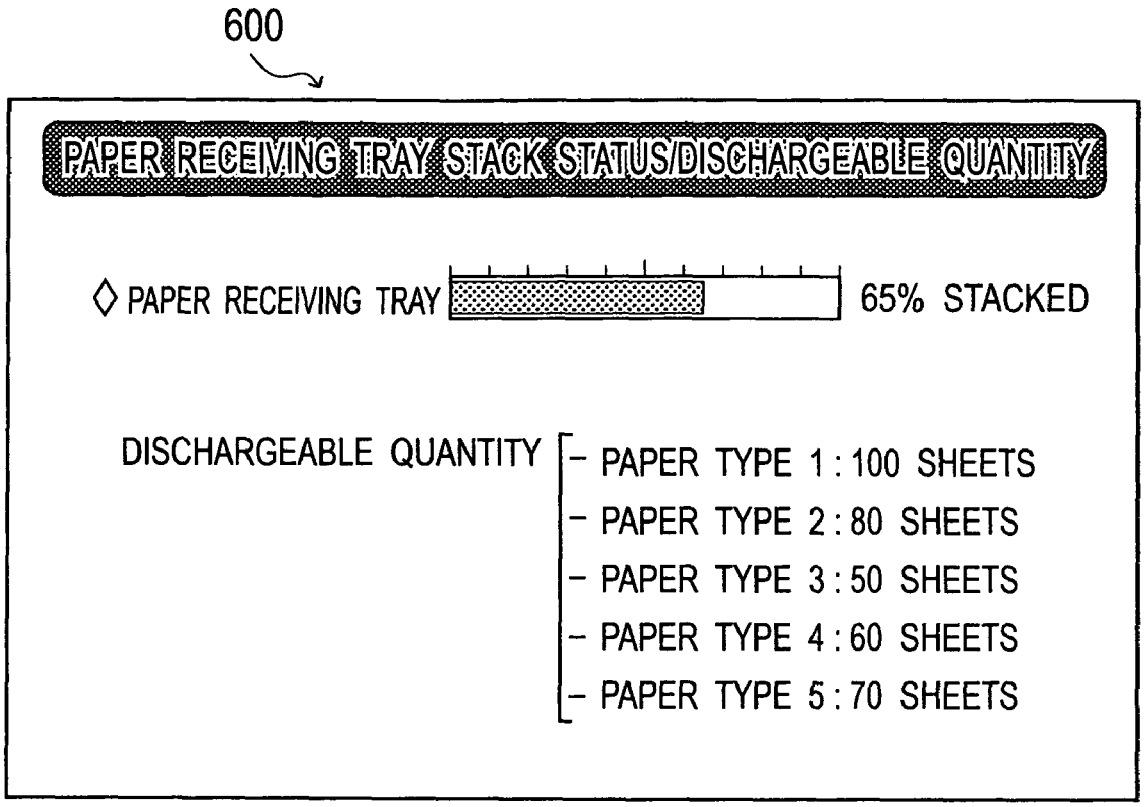
FIG. 9 is an example of a screen which is displayed on a display of the printer according to the embodiment of the present invention.

The notification unit 333 is a module configured to notify a user of the dischargeable number of sheets calculated by the dischargeable sheet amount calculator 334 and the determination based on the result of the comparison by the comparator 335, by using a message or the like. The contents of this message are switched according to not only the dischargeable number of sheets calculated by the dischargeable sheet amount calculator 334 but also whether or not the stack amount exceeds 80%, whether or not the job data can be printed, and the like. A display 342 visually notifies a user of this message. An example (notification screen 600) of this notification by the notification unit 333 is shown in FIG. 9. The notification by the notification unit 33 may be performed by not only displaying a message but also using beep tones or voices.

(Discharged Sheet Monitoring Method)

Figure 4A:
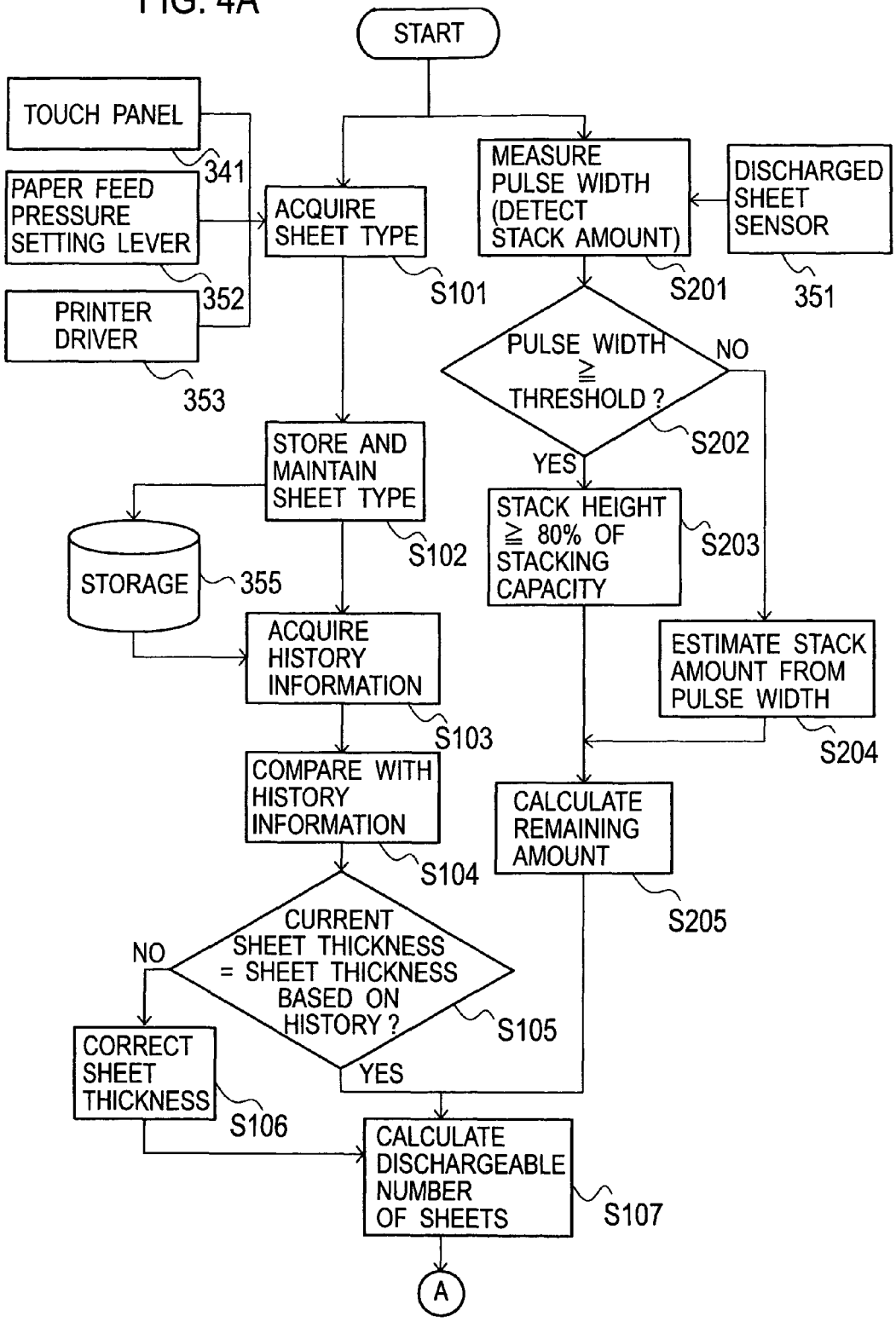
FIGS. 4A and 4B are flowcharts showing the operation of a discharged sheet monitoring mechanism according to the embodiment of the present invention.
Figure 4B:
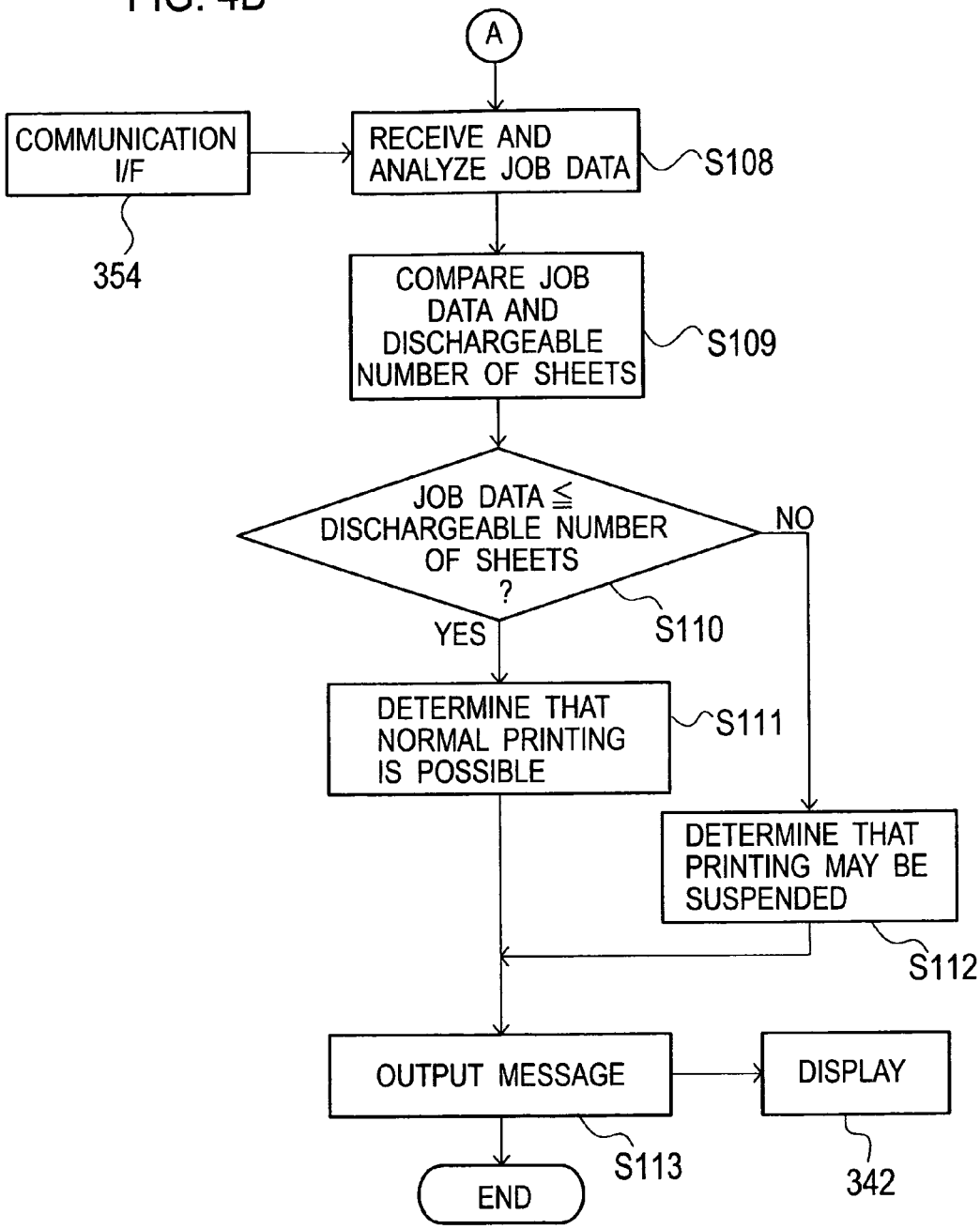

A discharged sheet monitoring method according to an embodiment of the present invention can be implemented by operating the discharged sheet monitoring mechanism having the above-described configuration. FIGS. 4A and 4B are flowcharts showing the operation of the discharged sheet monitoring mechanism of this embodiment.

First, in the sheet type recognition module group, the sheet type acquisition unit 336 acquires a sheet type (S101) based on process execution through a touch panel 341 and the printer driver 353 and a setting on the paper feed pressure setting lever 352. The acquired sheet type is additionally stored on the storage 355 (S102). At this time, the estimator 337 acquires history information stored on the storage 355 before this time (S103). Then, the estimator 337 estimates a sheet type based on past use history and compares this sheet type with the sheet type acquired this time (S104).

If the estimator 337 determines, based on this comparison, that the sheet type acquired this time is equal to the estimated sheet type (YES in S105), the estimator 337 sends current sheet thickness data to the dischargeable sheet amount calculator 334. On the other hand, if the estimator 337 determines that the sheet type acquired this time is greatly different from the estimated sheet type (NO in S105), the estimator 337 corrects the sheet thickness (S106) and sends corrected sheet thickness data to the dischargeable sheet amount calculator 334. In the sheet thickness correction, a sheet thickness may be selected according to the intent of a user by displaying, to the user, a message for specifying which thickness to use and by requesting a selecting operation from the user.

In parallel with the above-described processing by the sheet type recognition module group, in the paper receiving tray remaining amount calculation module group, the current stack amount of discharged sheets is detected based on the pulse width measured by the discharged sheet sensor 351 (S201). If the pulse width is a predetermined threshold or more (YES in S202), a determination is made that the discharged-sheet stack height of the paper receiving tray 150 has reached 80% of the maximum stacking amount (S203). Then, the remaining amount is calculated to be "20% or less" (S205), and the data is sent to the dischargeable sheet amount calculator 334.

On the other hand, if the pulse width is less than the threshold in step S202 (NO in S202), a determination is made that the discharged-sheet stack height of the paper receiving tray 150 is less than 80% of the maximum stacking amount (S203). Then, the stack amount of discharged sheets is estimated from the pulse width (S204), and the remaining amount is calculated (S205). This calculated remaining amount is sent to the dischargeable sheet amount calculator 334. In this pulse-width-based estimation, the speed at which a print sheet falls relates to the distance to a landing point. The falling speed is lower when the landing point is closer. On the other hand, when the landing point is farther, the falling speed is higher because of lower air resistance. Accordingly, the stack amount of print sheets on the paper receiving tray can be estimated by measuring the pulse width.

Subsequently, in the dischargeable sheet amount notification module group, the dischargeable sheet amount calculator 334 calculates a dischargeable number of sheets (S107) based on the sheet thickness data obtained through the processing (S101 to S105) performed by the sheet type recognition module group and the remaining amount data obtained through the processing (S201 to S205) performed by the paper receiving tray remaining amount calculation module group. The dischargeable number of sheets calculated at this stage may be reported to the user through the display 342 and the printer driver 353 by outputting a message before the reception of print JOB data.

Then, the JOB data received through the communication I/F 354 is analyzed to extract the number of sheets to be printed of the job (S108). The number of sheets to be printed of the JOB data is compared with the dischargeable number of sheets calculated by the dischargeable sheet amount calculator 334 (S109). If the number of sheets to be printed of the JOB data is the dischargeable number of sheets or less in step S109 (YES in 110), the JOB data is processed as normal printing, and a message to that effect is outputted to the display 342 (S111 and S113). On the other hand, if the number of sheets to be printed of the JOB data is greater than the dischargeable number of sheets (NO in S110), a message to the effect that printing may be suspended is outputted to the display 342 (S112 and S113).

Figure 10:
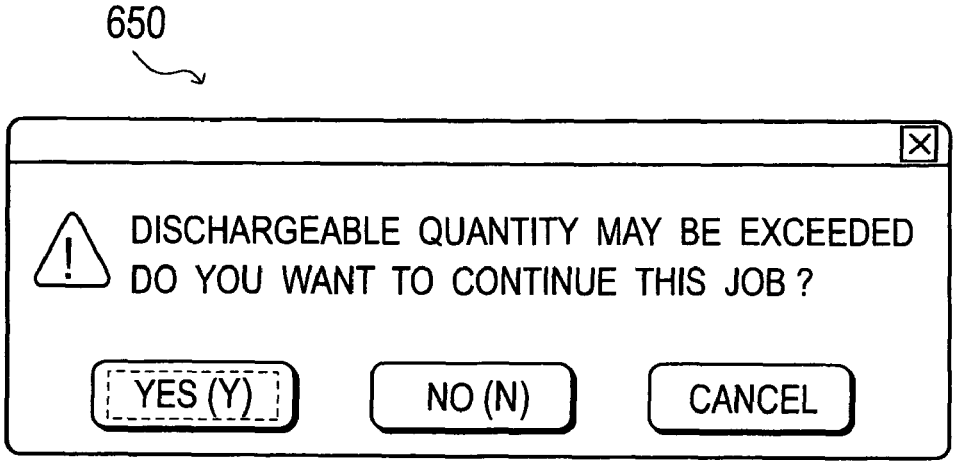
FIG. 10 is an example of a screen which is displayed on the display of the printer according to the embodiment of the present invention.

According to this embodiment, the dischargeable number of sheets is calculated based on the remaining stacking amount calculated from the discharged-sheet stack amount detected in the stack amount detecting step (S201 to S205) and the sheet type acquired in the sheet type acquiring step (S101 to S105). Accordingly, the user can be notified of an accurate dischargeable number of sheets calculated with consideration given to the thickness of a sheet to be used. Thus, the user can give a print instruction after comparing the dischargeable number of sheets reported in the notifying step and the number of sheets that a user desires to print. This can reduce the occurrence of a discharged sheet jam and improve the working efficiency of printing. In this case, the user can compare the dischargeable number of sheets and the number of sheets to be printed put into a single batch as job data. Accordingly, in the case where discharged sheets overflows beyond the maximum stacking amount of the paper receiving tray 150 if a print operation is executed, the notification unit 333 can notify the user to that effect. An example (notification screen 650) of this notification by the notification unit 333 is shown in FIG. 10.

Further, the types of used sheets are analyzed based on the history information stored and maintained on the storage 355, and the dischargeable number of sheets is corrected based on the sheet type estimated by the estimator 337. Accordingly, an appropriate current maximum dischargeable number of sheets can be calculated with consideration given to not only current sheet settings but also the tendency of past sheet uses.

Moreover, in the stack amount detection, the stack amount of the paper receiving tray 150 is estimated and detected based on the length of time during which the discharged sheet sensor 351 continuously receives reflected light. This feature makes it possible to measure the stack amount by determining whether discharged sheets are stacked or not at a predetermined height where the discharged sheet sensor 351 is located. Also, even when the stack amount does not reach the predetermined height, this feature makes it possible to estimate the current discharged-sheet stack amount of the paper receiving tray 150, and to calculate the remaining amount which is the height of discharged sheets further stackable until the paper receiving tray 150 is full with discharged sheets.

Consequently, the printer discharged sheet monitoring mechanism and method according to this embodiment can improve the efficiency of user's work and enable the user to make the best use of the maximum capacity (maximum stacking amount of discharged sheets) of the paper receiving tray 150 in a printer such as an inkjet printer by recognizing the type of a discharged sheet, the remaining amount of the paper receiving tray 150, and the like, calculating an accurate further dischargeable number of sheets, and notifying the user of this dischargeable number of sheets.

Although this embodiment is an example in which one discharged sheet sensor 351 is provided, the present invention is not limited to this. That is, two or more discharged sheet sensors 351 may be provided in the paper receiving tray 150. For example, one possible configuration is as follows: a first discharged sheet sensor is located at a height corresponding to 80% of the maximum discharged-sheet stacking amount of the paper receiving tray 150, and a second discharged sheet sensor is located at a height corresponding to 40% of the maximum discharged-sheet stacking amount of the paper receiving tray 150. This configuration makes it possible to not estimate but to reliably detect that the amount of discharged sheets has reached a height corresponding to 40% of the maximum stacking amount of the paper receiving tray 150. Accordingly, a more accurate current stack amount of discharged sheets can be obtained. That is, a more accurate dischargeable number of sheets can be estimated.

The discharged-sheet monitoring mechanism and method for a printer according to the embodiments of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. A discharged sheet monitoring mechanism for a printer, comprising:

a paper receiving tray configured to receive and stack discharged printed sheets thereon;

a stack amount detector configured to detect a stack amount of discharged sheets stacked on the paper receiving tray;

a remaining amount calculator configured to calculate a remaining amount based on the stack amount detected by the stack amount detector, the remaining amount being a difference in amount between the stack amount and a maximum stacking amount of the paper receiving tray;

a sheet type acquisition unit configured to acquire a type of a sheet to be printed;

a dischargeable sheet amount calculator configured to calculate a dischargeable number of sheets further stackable on the paper receiving tray until the paper receiving tray is full therewith based on the remaining amount calculated by the remaining amount calculator and the sheet type acquired by the sheet type acquisition unit; and a notification unit configured to notify a user of the dischargeable number of sheets calculated by the dischargeable sheet amount calculator.

2. The discharged sheet monitoring mechanism according to claim 1, further comprising:

a print data processor configured to process multiple-sheet printing as a single batch of job data; and a comparator configured to compare a number of sheets to be printed contained in the job data and the dischargeable number of sheets, wherein the notification unit notifies the user of a result of the comparison performed by the comparator.

3. The discharged sheet monitoring mechanism according to claim 1, further comprising:

a storage configured to store the sheet type acquired by the sheet type acquisition unit as history information; and an estimator configured to analyze types of sheets used for printing based on the history information stored in the storage, wherein the dischargeable sheet amount calculator corrects the dischargeable number of sheets based on a sheet type estimated by the estimator.

4. The discharged sheet monitoring mechanism according to claim 2, further comprising:

a storage configured to store the sheet type acquired by the sheet type acquisition unit as history information; and an estimator configured to analyze types of sheets used for printing based on the history information stored in the storage, wherein the dischargeable sheet amount calculator corrects the dischargeable number of sheets based on a sheet type estimated by the estimator.

5. The discharged sheet monitoring mechanism according to claim 1, wherein the sheet type acquisition unit acquires the type of a sheet to be printed by acquiring information on a sheet type specified through an operation by the user.

6. The discharged sheet monitoring mechanism according to claim 2, wherein the sheet type acquisition unit acquires the type of a sheet to be printed by acquiring information on a sheet type specified through an operation by the user.

7. The discharged sheet monitoring mechanism according to claim 1, wherein the sheet type acquisition unit acquires the type of a sheet to be printed by acquiring information on a paper feed pressure set in a paper feed unit configured to feed a sheet to a conveyance route for conveying the sheet for image formation.

8. The discharged sheet monitoring mechanism according to claim 2, wherein the sheet type acquisition unit acquires the type of a sheet to be printed by acquiring information on a paper feed pressure set in a paper feed unit configured to feed a sheet to a conveyance route for conveying the sheet for image formation.

9. The discharged sheet monitoring mechanism according to claim 1, wherein the stack amount detector comprises a light receiving sensor configured to detect a presence of a discharged sheet and detects the stack amount of discharged sheets stacked on the paper receiving tray based on a length of time during which the light receiving sensor continuously detects a discharged sheet.

10. The discharged sheet monitoring mechanism according to claim 2, wherein the stack amount detector comprises a light receiving sensor configured to detect a presence of a discharged sheet and detects the stack amount of discharged sheets stacked on the paper receiving tray based on a length of time during which the light receiving sensor continuously detects a discharged sheet.

11. The discharged sheet monitoring mechanism according to claim 1, wherein the paper receiving tray is provided at an end of a discharging route for discharging a printed sheet, the discharging route being branched from and connected to a conveyance route for conveying a sheet for image formation, the stack amount detector comprises a light receiving sensor configured to detect a presence of a discharged sheet by emitting irradiation light and by receiving reflected light of the emitted irradiation light from the sheet discharged from the discharging route, the light receiving sensor being located at a height corresponding to a predetermined percentage of the maximum stacking amount of the paper receiving tray, and the stack amount detector detects the stack amount of discharged sheets stacked on the paper receiving tray based on a length of time during which the light receiving sensor continuously detects the presence of a discharged sheet.

12. The discharged sheet monitoring mechanism according to claim 2, wherein the paper receiving tray is provided at an end of a discharging route for discharging a printed sheet, the discharging route being branched from and connected to a conveyance route for conveying a sheet for image formation, the stack amount detector comprises a light receiving sensor configured to detect a presence of a discharged sheet by emitting irradiation light and by receiving reflected light of the emitted irradiation light from the sheet discharged from the discharging route, the light receiving sensor being located at a height corresponding to a predetermined percentage of the maximum stacking amount of the paper receiving tray, and the stack amount detector detects the stack amount of discharged sheets stacked on the paper receiving tray based on a length of time during which the light receiving sensor continuously detects the presence of a discharged sheet.

13. A method for monitoring a discharged sheet, the method comprising:

detecting a stack amount of discharged sheets stacked on a paper receiving tray configured to receive discharged printed sheets;

calculating a remaining amount based on the stack amount detected in the stack amount detecting step, the remaining amount being a difference in amount between the stack amount and a maximum stacking amount of the paper receiving tray;

acquiring a type of a sheet to be printed;

calculating a dischargeable number of sheets further stackable on the paper receiving tray until the paper receiving tray is full therewith based on the remaining amount calculated in the remaining amount calculating step and the sheet type acquired in the sheet type acquiring step; and notifying a user of the calculated dischargeable number of sheets.

14. The method for monitoring a discharged sheet according to claim 13, wherein, in the stack amount detecting step:

the stack amount of discharged sheets stacked on the paper receiving tray is detected based on a length of time during which a light receiving sensor continuously detects a presence of a discharged sheet, the paper receiving tray is provided at an end of a discharging route for discharging a printed sheet, the discharging route branched from and connected to a conveyance route for conveying a sheet for image formation, the light receiving sensor being located at a height corresponding to a predetermined percentage of a maximum stacking amount of the paper receiving tray and configured to detect the presence of a discharged sheet by emitting irradiation light and by receiving reflected light of the emitted irradiation light from the sheet discharged from the discharging route.

15. The discharged sheet monitoring mechanism according to claim 1, wherein:

the notification unit is configured to notify the user of the calculated dischargeable number of sheets, with consideration given to the thickness of a sheet to be used by the user, and the notification unit is configured to notify the user of an expected overflow condition in the case where the calculated number of sheets would overflow beyond the maximum stacking amount of the paper receiving tray upon execution of the print job.

16. The discharged sheet monitoring mechanism according to claim 2, wherein a start of print processing with respect to the job data is suspended upon the number of sheets to be printed contained in the job data exceeding the dischargeable number of sheets.

17. The method for monitoring a discharged sheet according to claim 13, further comprising:

notifying a user of the calculated dischargeable number of sheets, with consideration given to the thickness of a sheet to be used by the user; and notifying the user of an expected overflow condition in the case where the calculated number of sheets would overflow beyond the maximum stacking amount of the paper receiving tray upon execution of the print job.

18. The method for monitoring a discharged sheet according to claim 17, wherein the start of print processing with respect to the job data as suspended is restarted or canceled through an operation by the user.

* * * * *